United States Patent [19]

Rask

[11] Patent Number: 4,516,102

[45] Date of Patent: May 7, 1985

[54] ELECTRICALLY-POWERED EXPANSION/CONTRACTION APPARATUS

[76] Inventor: Mark C. Rask, 4205 - 46th Ave. North, Minneapolis, Minn. 55422

[21] Appl. No.: 548,214

[22] Filed: Nov. 2, 1983

[51] Int. Cl.[3] ..... H01F 7/08

[52] U.S. Cl. ..... 335/267; 335/229; 335/268; 3/1.1

[58] Field of Search ..... 335/209, 229, 230, 266, 335/267, 268; 3/1, 1.1

[56] References Cited

U.S. PATENT DOCUMENTS

| | | | |
|---|---|---|---|
| 2,161,374 | 6/1939 | Moineau | 103/118 |
| 2,532,876 | 12/1950 | Asche et al. | 172/126 |
| 3,161,793 | 12/1964 | Laithwaite | 335/229 X |
| 3,940,803 | 3/1976 | Weis, Jr. et al. | 3/1.1 |
| 4,067,070 | 1/1978 | Seamone et al. | 3/1.1 |
| 4,074,367 | 2/1978 | Loveless | 3/1.1 |
| 4,077,027 | 2/1978 | Ioffe et al. | 335/219 |
| 4,078,267 | 3/1978 | Cleszynski | 3/1.7 |
| 4,121,139 | 10/1978 | Putt | 335/268 X |
| 4,143,426 | 3/1979 | Hall et al. | 3/6 |
| 4,176,411 | 12/1979 | Runge | 3/1.7 |
| 4,209,860 | 7/1980 | Graupe | 3/1.1 |

OTHER PUBLICATIONS

"Era of Bionics Person Moves Nearer to Reality", U.S. News and World Report, Mar. 13, 1978.

*Primary Examiner*—George Harris

*Attorney, Agent, or Firm*—Merchant, Gould, Smith, Edell, Welter, & Schmidt

[57] ABSTRACT

An electrically-powered expansion/contraction apparatus is disclosed. The apparatus preferably contracts and expands due to magnetic interaction within a plurality of motor units (20) or (21). Each motor unit (20) or (21) is in turn made up of a pair of interlinked subunits (22), (24). The subunits (22), (24) include inner elements (22) and outer elements (24) which contract when unlike magnetic poles are juxtaposed and expand when opposite poles are proximate to one another. A control circuit (44) for each subunit (22), (24) selectively prevents current flow or directs it in one of two directions to appropriately empower electromagnets (26) on the inner elements (22). Outer elements (24) can either include permanent magnets (40) or electromagnets (27). Mechanical stop means are provided by the nature of the interlinked design to give the motor unit (20) or (21) an "all-or-none" behavior akin to that of natural muscle.

14 Claims, 10 Drawing Figures

TO CONTROL CIRCUIT
TO CONTROL CIRCUIT 20
22a
22b
24a
24b
26
26a
26b
28a
28b
30a
30b
31
32
34
36a
36b
38a
38b
39a
39b
40a
40b
42
42a
42b
44
46
48
50
4

ELECTRICALLY-POWERED EXPANSION/CONTRACTION APPARATUS

FIELD OF THE INVENTION

The invention of the present application relates generally to electrically-powered expansion and contraction devices and more particularly to electrically powered expansion and contraction devices suitable for use in the robotics area and as synthetic muscles, among other uses.

BACKGROUND OF THE INVENTION

It is generally recognized that there is a need for electrically powered expansion and contraction devices in many fields including robotics and prosthetics. Expansion/contraction units, or "motive" units, are needed in welding robots on automobile assembly lines, for example, and in undersea robots useful for oil rig repair.

Just as robot "limbs" need motive units, artificial or prosthetic limbs for humans also require motive units. Similarly, artificial hearts require some type of motive unit to pump blood.

Robot and prosthetic limbs aside, there are innumerable applications where simple expansion/contraction devices are needed. The remainder of the present application will be directed to artificial limbs, though it should again be noted that the expansion/contraction device of the present invention is not limited to motive components for artificial limbs. The expansion/contraction device of the present invention will variously be referred to as an "artificial muscle," "synthetic muscle," motive unit or expansion and contraction device throughout the application.

Several types of motive units for electrically powered artificial muscles have been developed. Electrically powered rotary motors, including stepper motors, sometimes in combination with simple solenoids, have been utilized. For example, see U.S. Pat. Nos. 4,074,367 and 4,067,070. Another type of artificial muscle that has been developed comprises an electromagnet imbedded in a resilient material that acts to bind a plurality of magnetic particles. U.S. Pat. No. 2,532,876, issued to Asche et al, and U.S. Pat. No. 4,176,411, issued to Runge, are representative of this type of synthetic muscle. The Asche and Runge devices function in a similar fashion: When the electromagnet that is surrounded by or imbedded in the resilient material is energized, either directly or inductively, the magnetic particles imbedded in the resilient material are either pulled toward the electromagnet or pushed outward, away from the electromagnet, depending on whether the magnetic particles are themselves magnetized, and depending on the orientation of the poles of the electromagnet as compared to the orientation of the poles of the individual magnetic particles. It should be noted that throughout the present application the term "magnetic" connotes something that is magnetized, capable of being magnetized, or simply attracted and/or repelled by a force created by a magnetic field in the proximity of the material. "Magnetized" in the present application, unless the context indicates otherwise, means that the magnetic material has an established north and south pole. A "magnet" in the present application may be either a permanent magnet or an electromagnet.

It is perceived that the Asche et al and Runge type of synthetic muscle possesses several shortcomings. First, a certain amount of energy is irreversibly wasted each time the resilient substrate is deformed and then returned to its original shape. This is due to the nature of the resilient material that comprises the substrate. Secondly, it is perceived that the amount of contraction or expansion of an Asche or Runge muscle, or similar device, is dependent to some degree on the load on the synthetic muscle. That is, once the electromagnet of the Asche or Runge muscle is stimulated, the magentic particles will move and the substrate will deform until forces generated by the resilient substrate and the load on the muscle combine to substantially equal the force generated by the electromagnet on the magnetic particles, and an equilibrium point is established. It can be seen that when the load on the synthetic muscle changes, this point of equilibrium changes and the amount of expansion or contraction varies. Such a muscle therefore does not operate in an "all-or-none" mode. Natural muscle fibers, on the other hand, either fully contract or do not contract at all, thereby functioning as a binary (contracted or not contracted) system. It is thought that a synthetic "muscle fiber" functioning in the nature of a natural muscle fiber, i.e., according to the all-or-none law, is desirable. A "binary" or all-or-none muscle fiber is more amenable to digital control than a muscle of the Asche or Runge design, and perhaps ultimately would be more easily interfaced and controlled by the impulses transmitted by the nervous system of an individual.

Another perceived shortcoming of the Asche/Runge type of muscle is that "muscle tone" is not easily achievable. Under a varying load, an Asche/Runge muscle would deform until a new equilibrium point is established, unless the electromagnet is energized to compensate for the varying load to maintain the original equilibrium point.

It is also perceived that resilient materials as used in the Asche and Runge synthetic muscles are typically sensitive to temperature variations and aging effects. The modulus of elasticity or spring constant of a resilient material is usually at least somewhat dependent upon the age of the material and its physical environment. Furthermore, the spring constant of a resilient material may be a function of the degree of deformation of the material, if the material has non-linear characteristics.

The invention of the present application addresses the aforementioned shortcomings possessed by the prior art synthetic muscles. A synthetic muscle according to the present invention is comprised of a plurality of motor units, each of the motor units preferably comprising a pair of electromagnets and a pair of motor elements that are movable when subjected to a magnetic field. In this embodiment, an electromagnet and a motor element form a motor subunit, and the pair of motor subunits are interconnected so that when they contract the motor unit contracts and thus the entire synthetic muscle contracts. In a preferred embodiment, expansion of the synthetic muscle follows a similar sequence. Each motor subunit of the present invention freely expands and contracts between an upper and a lower limit. For example, in the contraction mode of the synthetic muscle according to the present invention, when the electromagnet is energized, either directly or inductively, the motor element snaps from a distal position, the upper limit, to a proximal position, the lower limit.

Each of the positions is limited by stop means as further discussed below.

The motor unit for an artificial limb that comprises an electromagnetic expansion/contraction device according to the present invention is able to produce a linear motion, thus better mimicking a natural muscle without requiring a rotary-to-linear transducer. An artificial muscle according to the present invention can be made quite small depending on the application. Also, rotary bearings are generally unnecessary. Thus, the presently-invented synthetic muscle motor unit addresses the shortcomings of electrically powered rotary motors. Also, a muscle according to the instant invention is contracted or expanded to a degree dependent on the number of motor units that are energized or stimulated. This characteristic closely mimics the functioning of a natural muscle and also allows the artificial muscle to be more easily controlled using digital electronic techniques. Comparable control techniques for rotary motors are more complicated.

A further advantage of the present invention over the artificial muscles of Asche and Runge is that a resilient substrate is not required to bind a plurality of magnetic particles, and therefore the problems of a varying spring constant and dissipation of energy during a contraction-/expansion cycle are obviated. The amount of contraction/expansion of the presently-invented artificial muscle is dependent upon the number of motor units energized, whereas the amount of deformation of an Asche or Runge muscle depends on the magnitude of the load and the amount of current driven through the electromagnet's coil. Thus, again, the all-or-none law is more closely observed with the artificial muscle of the present invention, readily adapting to digital control.

Also, the movement resolution of an artificial muscle according to the present invention depends on the number of motor units in end-to-end or collinear alignment, the larger the number of units the finer the resolution. The number of motor units that is energized can be gradually changed to effect a smooth contraction or expansion of the artificial muscle. Conversely, in the Asche or Runge muscle, if the electromagnet is pulsed with a predetermined amount of current the muscle will deform accordingly and fairly suddenly, leading to a contraction or expansion that is less smooth.

With respect to all of the artificial muscles of the prior art discussed above, an artificial muscle of the present application better addresses the problem of "muscle tonus." Muscle tone in a natural muscle is achieved by the continuous stimulation of a select number of muscle fibers. In the instant invention, the same or similar characteristic is achieved by energizing a select number of motor units.

SUMMARY OF THE INVENTION

The present invention comprises an electrically powered expansion and contraction device including a plurality of motor units, each of the motor units including a pair of subunits that are preferably interlinked as discussed below.

Each subunit includes a means for emanating a force field and a motor element movable with respect to the force field emanating means. In a preferred embodiment, the force field emanating means includes an electromagnet and the motor element includes a magnetic material that may be magnetized so that contraction and expansion may be actively induced by running current through the electromagnet in one direction or the other.

Each motor subunit also includes means for operatively connecting the force field emanating means to the motor element so that the motor element can be moved substantially freely between an upper limit and a lower limit, so limited by a stop means. The stop means acts to mechanically limit the relative motion of the force field emanating means and the motor element to a predetermined range. An upper and lower limit are fixed by the stop means. A plurality of motor units are interconnected to form an artificial muscle and the contraction or expansion of the artificial muscle is the result of the cumulative expansions and contractions of the individual motor subunits and units.

The motor elements are preferably magnetic, and are either magnetized or are electromagentic. They thus react to magnetic fields generated by the electromagnets of their associated force field emanating means.

In a preferred embodiment, a pair of subunits are interlinked wherein a first member connects a first subunit motor element to a second subunit force field emanating means, and a second member interconnects a first subunit force field emanating means and a second subunit motor element. In this embodiment, expansion of the subunits is limited by the interference of the first and second force field emanating means and the force generated by this interference is transmitted by the first and second members to the first and second motor elements to restrict their motion relative to the first and second force field emanating means. Likewise, the contraction of an individual motor unit is mechanically limited. Thus, the relative motion between the subunit force field emanating means and the corresponding subunit motor element is substantially uninhibited except for the upper and lower limits established by the mechanical stop means.

A linear expansion and contraction device includes a plurality of axially-aligned motor units, and the expansion of the device is due to the cumulative or net expansion of the pluarlity of motor units.

A planar device includes a plurality of parallel-aligned motor units. Th force generated by the motor units is cumulative, potentially resulting in a significant motive force.

DETAILED DESCRIPTION OF THE INVENTION

Figures 1, 2, 3:
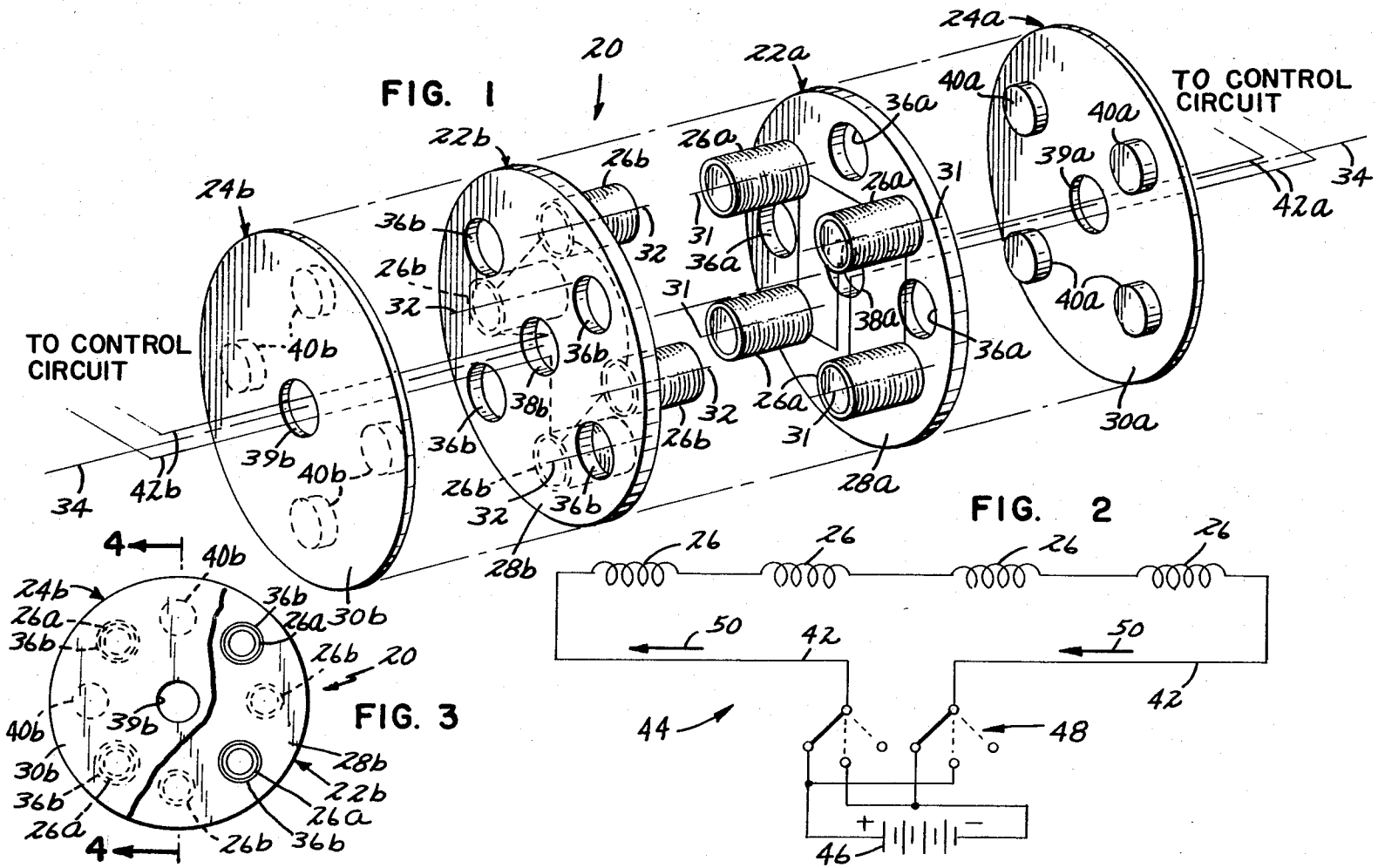
FIG. 1 is an exploded perspective view of a motor unit of an electrically-powered expansion/contraction device of the present invention. The motor elements including permanent magnets.
FIG. 2 is a schematic of an electrical control circuit for the expansion/contraction device shown in FIG. 1.
FIG. 3 is an end elevational view, partially broken, of the expansion/contraction device shown in FIG. 1.

The expansion/contraction device of the present invention will be described with reference to the attached figures, wherein like reference numerals represent like components and assemblies throughout the figures.

FIG. 1 shows an exploded perspective view of a single motor unit of an expansion/contraction device of the present invention. The motor unit is represented generally with the reference numeral 20. The motor unit 20 includes a pair of inner elements 22*a* and 22*b* and a pair of outer elements 24*a* and 24*b*. The inner elements 22 each include a plurality of inside electromagnets 26 which are fixedly connected to inside element substrates 28 and similarly fixed to outside element substrates 30. Inside electromagnets 26*b* of inside element 22*b* are fixed to substrates 28*b* and 30*a*, whereas inside electromagnets 26*a* of inside element 22*a* are fixed to substrates 28*a* and 30*b*. The inside electromagnets 26*a* are preferably welded to the inside element substrate 28*a* and outside element substrate 30*a*, extending substantially perpendicular to the substrates 28*a* and 30*a* and having axes 31 that are substantially parallel to a longitudinal axis 34 passing through the center of motor unit 20, and that are substantially perpendicular to the inside element substrate 28*a* and outside element substrate 30*a*. Similarly, the inside electromagnets 26*b* are preferably welded to inside element substrate 28*b* and outside element substrate 30*b*, extending substantially perpendicular to the substrates 28*b* and 30*b* and having axes 32 that are substantially parallel to a longitudinal axis 34 passing through the center of motor unit 20, and that are substantially perpendicular to the inside element substrate 28*b* and outside element substrate 30*b*.

Each of the inside electromagnets 26 includes a core preferably of a ferro-magnetic material, for example iron, and the core is encircled by a continuous coil of an electrical conductor, preferably a copper wire. The copper wire is wound around the cores of inside electromagnetics 26 in a fashion that is well-known in the art of electromagnet fabrication.

The inside element substrates 28 form a plurality of electromagnet apertures 36 and each of the inside element substrates 28 also forms a wiring aperture 38.

Figure 4:
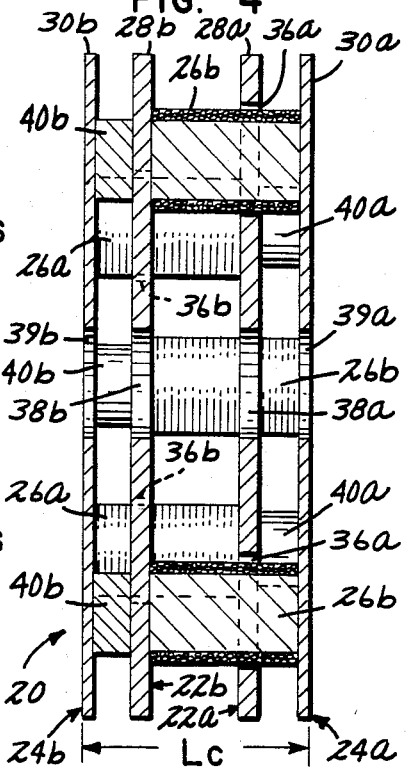
FIG. 4 is a side sectional view of an assembled motor unit of the type shown in FIG. 1 taken along line 4—4 of FIG. 3, in its contracted state with the distance $L_c$ being the length of the contracted motor unit.

Thus, as shown in FIG. 4, the inside electromagnets 26*b* interconnect inside element 22*b* and outside element 24*a*. Similarly, inside electromagnets 26*a* connect the inside element 22*a* to outside element 24*b*. The inside electromagnets 26*b* freely slide in electromagnet apertures 36*a* while inside electromagnets 26*a* similarly freely engage inside electromagnet apertures 36*b*.

Outside elements 24 each include a plurality of outside element permanent magnets 40. The permanent magnets 40*a* are configured to axially align with inside electromagnets 26*a* and permanent magnets 40*b* align with inside electromagnets 26*b*.

Thus, the motor unit 20 is made up of two interlinking subunits 22*a*, 24*a* and 22*b*, 24*b*. The electromagnets 26 and permanent magnets 40 of each of the subunits interact to cause the subunit to expand and contract as further discussed below. The expansions and contractions of the subunits causes the motor unit 20 to expand and contract.

Each set of inside electromagnets 26 is connected to a control circuit 44 as indicated in FIG. 1, and is discussed in detail with reference to FIG. 2. Insulated conductors 42 conduct electrical energy to and from the associated inside electromagnets 26. Thus, conductor 42*b* carries current from a control circuit (discussed in reference to FIG. 2) to the inside electromagnets 26*b* which are preferably wired in series as shown in FIG. 1. Conductor 42*a* functions similarly with respect to inside electromagnets 26*a*.

Permanent magnets 40 and electromagnets 26 are designed such that their magnetic poles are located substantially on the magnets' longitudinal axes. As noted above, the axes of the magnets are substantially parallel with the axis 34 of the motor unit 20 as a whole. The inside substrates 28 and outside substrates 30 can be fabricated from any material that will support the magnets 26 and 40 and the substrate 28 and 30 need not be electrically conductive or magnetically permeable.

It can thus be seen that the motor unit 20 is made up of a pair of interlinked subunits 22*a*, 24*a* and 22*b*, 24*b*. When the inside electromagnets 26 are properly energized as further discussed below, the subunits expand or contract which cause the motor unit 20 to likewise expand or contract. FIG. 2 shows an electrical control circuit 44 for one of the subunits 22, 24. The control circuit is designed to supply electrical current to the inside electromagnets 26 in one direction when the subunit 22, 24 is to be contracted, and another direction when the subunit 22, 24 is to be expanded. The control circuit 44 includes a power supply, i.e., a battery 46. It should be noted that the source of power for the control circuits 44 need not necessarily be a battery and the control circuits 44 could be connected to, for example, a digital computer so that the corresponding motor unit 20 could be selectively energized according to prescribed logic and timing formulae. Also included in the control circuit 40 is a six-pole, triple-throw switch 48. With the switch 48 in the position shown in FIG. 2, conventional current will flow through the control circuit 44 in a direction indicated by the arrows 50. This causes current to flow through the associated inside electromagnets 26 in a predetermined way to cause contraction of the subunit 22, 24 due to the interaction of the inside electromagnets 26 and outside permanent magnets 40 as further discussed below. On the other hand, when the switch 48 is placed in the position E as shown in FIG. 2, the conventional current will flow in a direction opposite to the arrows 50 and the interaction between the inside electromagnets 26 and outside permanent magnets 40 will cause the associated subunit 22, 24 to expand. Finally, when the switch 48 is placed in the "OFF" position as shown in FIG. 2, no current will flow through the control circuit 44 and the motor unit 20 will not be significantly urged to either expand or contract and the motor unit is rendered "flaccid." Apertures 39 in the outside element substrates 30 and apertures 38 in the inside element substrates 28 allow conductors 42 to carry electrical current to the electromagnets 26.

FIG. 3 is an end elevational view of the motor unit 20 shown in FIG. 1. The axis 34 of the motor unit 20 is seen on end in FIG. 3. Further, the preferred even spacing of the permanent magnets 40 and electromagnets 26 is illustrated.

Figure 5:
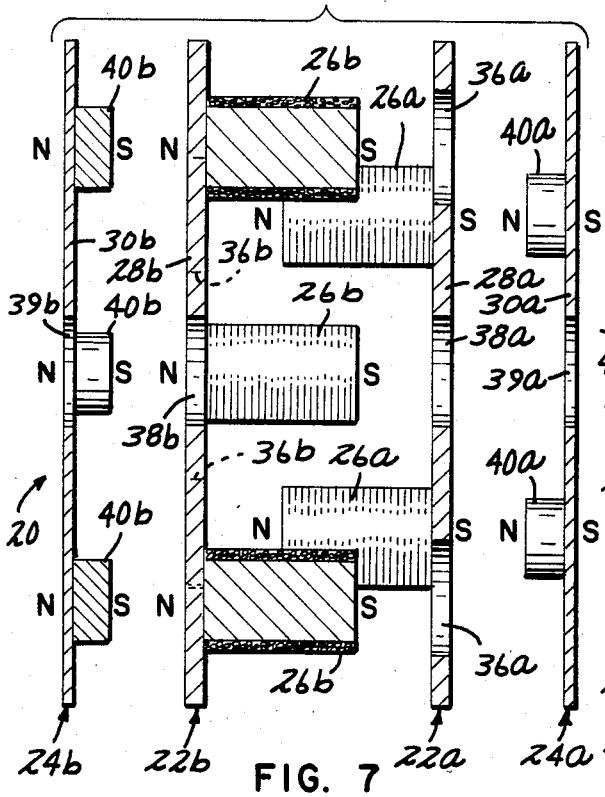
FIG. 5 is an exploded side sectional view of the motor unit shown in FIG. 1 illustrating a set of magnetic polarities that tends to contract the motor unit.

FIG. 5 is an exploded side view of the motor unit 20 showing one set of polarities of the permanent magnets 40 and electromagnets 26. The direction of the current flow through conductors 42 determines the polarities of electromagnets 26 as well-known in the art of electromagnet design and use. When the electromagnets 26 are polarized as shown in FIG. 5, the permanent magnets 40 and electromagnets 26 of each subunit are drawn together according to the well-known physical law that opposite poles attract. FIG. 4 shows the assembled motor unit 20 in its contracted state. Each subunit 22, 24 is drawn together by the attraction of its permanent magnets 40 and electromagnets 26, assuming that the load on the motor unit 20 is less than the total force operated by the magnetic interaction. The dimension $L_c$ represents the length of the contracted motor unit 20.

Figure 7:
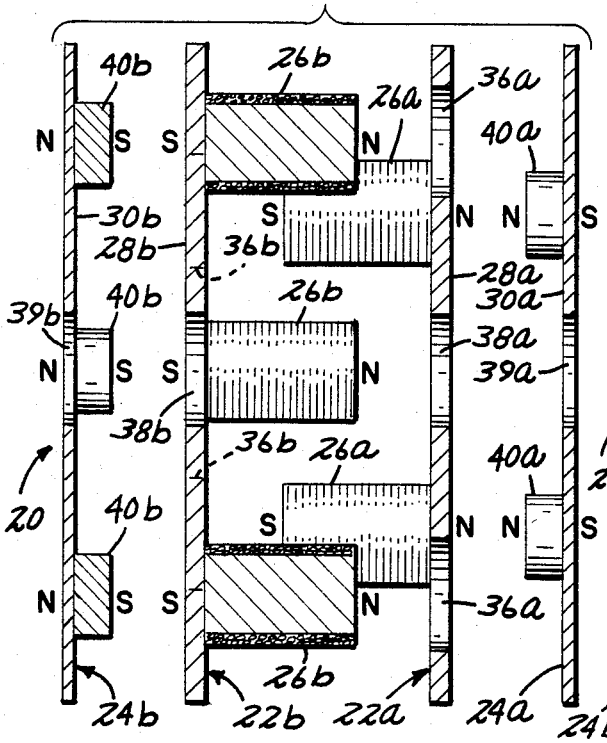
FIG. 7 is an exploded side view of the motor unit shown in FIG. 1 illustrating a set of magnetic polarities that tends to expand the motor unit.
Figure 6:
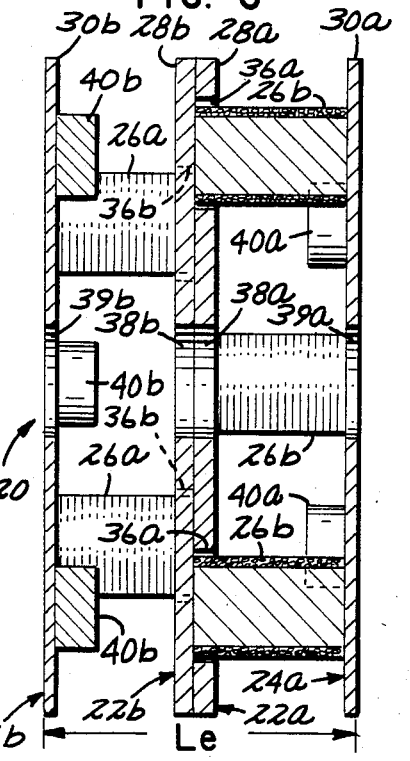
FIG. 6 is a side view of an assembled motor unit of the type shown in FIG. 1 in its expanded state, with the distance $L_e$ being the length of the motor unit in its expanded state.

Expansion of the motor unit 20 is effected by causing current to flow through the conductors 42 to set up the magnetic polarities as shown in FIG. 7. The permanent magnets 40 naturally must have the same magnetic polarities as shown in FIG. 5, but the electromagnets 26 have the opposite polarities of the electromagnets 26 in the contracted state. Hence, the permanent magnets 40 and electromagnets 26 of each subunit 22, 24 repel one another so that the motor unit 20 assumes an expanded state as shown in FIG. 6. It should be noted that mechanical stops are inherently provided by the preferred construction of the motor unit 20 as shown in the appended figures. The stops are provided to limit the subunit 22, 24 contraction and expansion to a predetermined amount so that the motor unit 20 has predetermined contracted and expanded lengths. The expanded length of the expanded motor unit 20 is indicated as $L_e$ in FIG. 6. $L_e$ is the maximum length that can be assumed by the motor unit 20 if it is constructed according to the particular design shown in the appended figures. Likewise, $L_c$ is the minimum length of the motor unit 20.

Thus, the motor unit 20 is either fully contracted or not contracted at all. This is due to the nature of the magnetic interaction between the permanent magnets 40 and the electromagnets 26 as well-known in the art of magnet circuit and component design. The magnetic attraction force between the magnets increases rapidly as the distance between the magnets decreases so that if a contraction has begun, it will continue until interference occurs between the mechanical components of the motor unit 20 to limit the contraction. This of course assumes that the load on the motor unit 20 is less than the magnetic force throughout the "stroke" of the motor unit 20.

Figure 8:
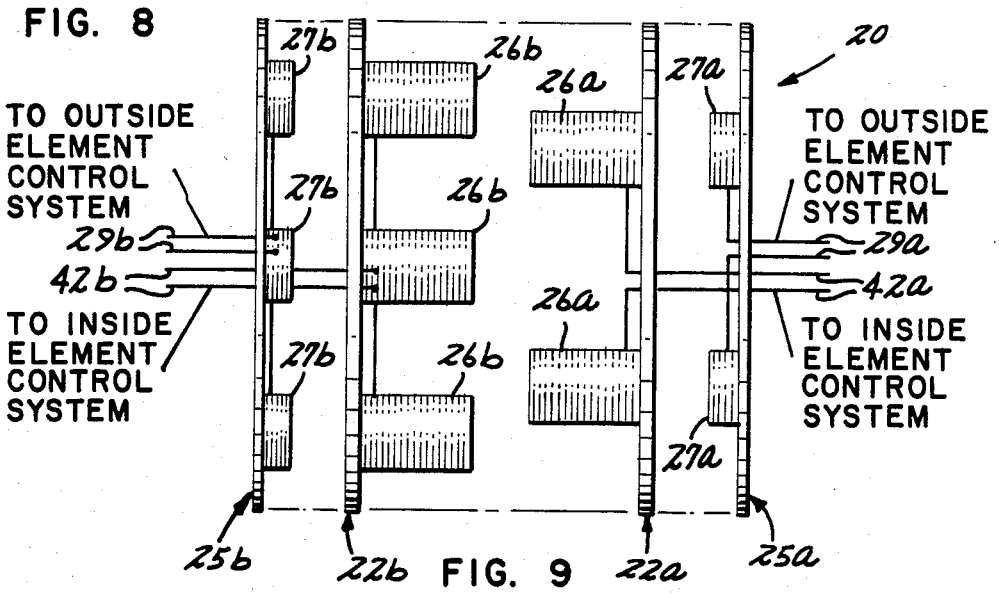
FIG. 8 is an exploded side view of a motor unit of an electrically powered expansion/contraction device of the present invention, the motor elements each including a plurality of electromagnets.

FIG 8 shows a second embodiment of a motor unit, generally labeled as 21. The motor unit 21 includes inner elements 22 which are wired with conductors 42 to control circuits as shown in the figures discussed above. However, the motor unit 21 includes outer elements 25 which include outer element electromagnets 27, the outer elements 27 being connected via outside electromagnet conductors 29 to outside element control systems that are preferably identical to the control system shown in FIG. 2. The outside electromagnets 27 can therefore be selectively energized to be "Off" or in one of two states of polarity as discussed above with reference to inside electromagnets 26. The inside electromagnets 26 interact with the outside electromagnets 27 in a fashion substantially similar to the interaction of the magnets in the motor unit 20, the first embodiment discussed above. However, since the electromagnets 27 can be selectively energized, the magnetic fields generated by the outside electromagnets 27 can be used to control the contracting or expanding force in a way not possible with simple permanent magnets 40.

In its preferred mode, the motor unit 20 or 21 is either fully contracted or fully expanded as limited by mechanical stops. With the exception of the mechanical stops, the electromagnets 26 freely engage (slide within) the apertures 36 of the substrates 28, and thus an intermediate equilibrium point between the fully contracted and fully expanded points preferably does not exist, particularly when the motor unit 20 or 21 is being contracted.

Figure 9:
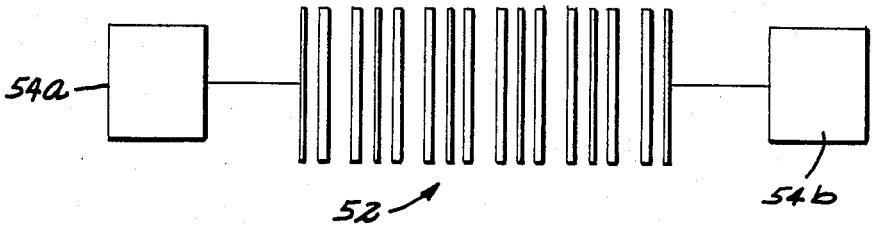
FIG. 9 is a schematic side representation of an electrically-powered expansion/contraction device having a plurality of axially-aligned motor units.

FIG. 9 shows a plurality of motor units 20 or 21 that are axially aligned to form a "linear" expansion/contraction device. The contraction of the linear expansion/contraction device is, in effect, the sum of all the contractions of the individual motor units 20 or 21 that form the linear device 52. The ends of the linear device 52 are attached to load points 54 and the points 54 are brought closer together by the contraction of one or more of the motor units 21 or 20 of the linear expansion/contraction device 22. Clearly, in order for the device 52 to contract or expand each of the motor units 20 or 21 of the device 52 must be able to generate enough force to move the load placed on the device 52. That is, the forces generated by the individual motor units 20 or 21 within the device 52 are not cumulative, although the length of contraction or expansion is due to the cumulative effect of all of the motor units 20 or 21.

Figure 10:
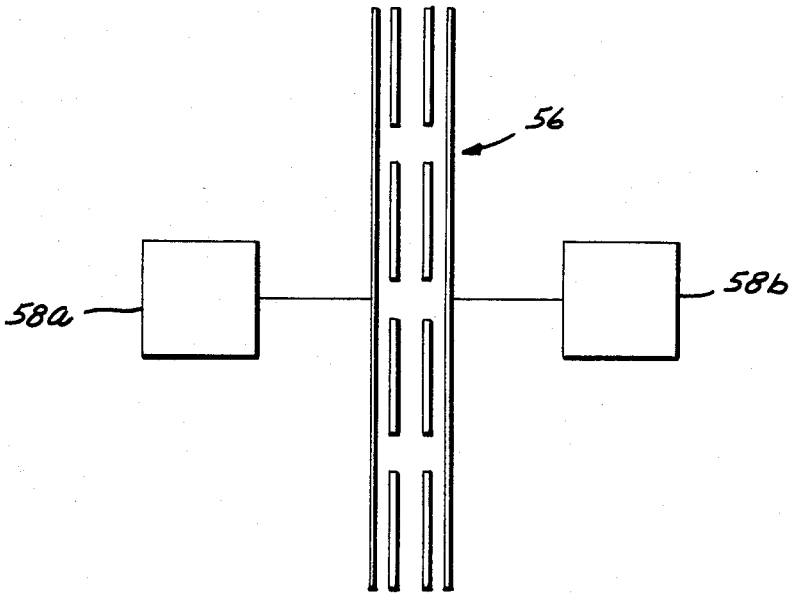
FIG. 10 is a schematic side representation of an electrically powered expansion/contraction device having a plurality of parallel-aligned motor units.

FIG. 10 shows a planar expansion/contraction device in which the forces generated by the individual motor units 20 or 21 are cumulative. That is, in an actual application of the planar device 56, the "controller" can progressively activate more and more motor units 21 or 20 until the load generated by 58 is overcome so that the planar device 56 either contracts or expands depending on the magnetic interaction between the magnets of the individual motor units 20 or 21.

Clearly, a plurality of planar devices 56 can be "linearly" mechanically connected so that they form a linear unit made up of a plurality of planar subunits 56. Likewise, a plurality of linear devices 52 can be strung in parallel to achieve similar results to the planar device 56 as discussed with reference to FIG. 10. In fact, any combination of linear and parallel interconnection is possible to form the particular characteristics desired for the application. A digital control device can be connected to a large number of individual motor units 20 and 21, with each of the motor units 20 or 21 having a particular address, to give the motive unit the desired characteristics. Such a computer-controlled motive unit could be used in a robot or potentially as a prosthetic device. Such a motor unit would provide "muscle tone" as a select few of the plurality of motor units 20 or 21 could be energized to give the "muscle" (motive unit) a slight tension. The all-or-none characteristics of the motive units 20 or 21 of the present invention simulate the functioning of a natural muscle and as such would have suitable application in the prosthesis area.

Other modifications of the invention will be apparent to those skilled in the art in light of the foregoing description. This description is intended to provide specific examples of individual embodiments which clearly disclose the present invention. Accordingly, the invention is not limited to these embodiments or to the use of elements having specific configurations and shapes as presented herein. All alternative modifications and variations of the present invention which follow in the spirit and broad scope of the appended claims are included.

I claim:

1. An electrically controlled expansion and contraction device comprising a plurality of motor units, each of said plurality of motor units comprising:

(a) first electrically powered means for emanating a first force field;

(b) second electrically powered means for emanating a second force field;

(c) a first motor element movable with respect to said first force field emanating means and in response to said first force field emanated therefrom, said first force field emanating means and said first motor element comprising a first motor subunit, a first variable distance being between said first force field emanating means and said first motor element, an increase of said first variable distance being an expansion of said first motor subunit and a decrease of said first variable distance being a contraction of said first motor subunit;

(d) a second motor element movable with respect to said second force field emanating means and in response to said second force field emanated therefrom, said second force field emanating means and said second motor element comprising a second motor subunit, a second variable distance being between said second force field emanating means and said second motor element, an increase of said second variable distance being an expansion of said second motor subunit and a decrease of said second variable distance being a contraction of said second motor subunit;

(e) first stop means mechanically connecting said first force field emanating means to said first motor element for preventing said first variable distance from being greater than a first upper limit and preventing said first variable distance from being less than a first lower limit while substantially freely permitting said first variable distance to vary between said first upper limit and said first lower limit;

(f) second stop means mechanically connecting said second force field emanating means to said second motor element for preventing said second variable distance from being greater than a second upper limit and preventing said second variable distance from being less than a second lower limit while substantially freely permitting said second variable distance to vary between said second upper limit and said second lower limit;

(g) motor subunit interconnecting means for mechanically connecting said first motor subunit to said second motor subunit; and (h) motor unit interconnecting means for mechanically connecting said each motor unit to another one of said plurality of motor units, whereby the cumulative expansions and contractions of said first and second motor subunits provide expansion and contraction of said motor units and the cumulative expansions and contractions of said motor units provide expansion and contraction of said expansion and contraction device.

2. The electrically controlled expansion and contraction device in accordance with claim 1, wherein said first force field emanating means comprises a first electromagnet, said second force field emanating means comprises a second electromagnet, and said first and second force fields each comprise a magnetic field.

3. The electrically controlled expansion and contraction device in accordance with claim 2, wherein said first and second motor elements each comprise a magentic material.

4. The electrically controlled expansion and contraction device in accordance with claim 3, wherein said magnetic material of said first and second motor elements is magnetized.

5. The electrically controlled expansion and contraction device in accordance with claim 2, wherein said first motor element comprises a first motor element electromagnet and said second motor element comprises a second motor element electromagnet.

6. The electrically controlled expansion and contraction device in accordance with claim 1, wherein said first stop means comprises said first force field emanating means and a first member operatively connecting said first motor element to said second force field emanating means, said second stop means comprises said second force field emanating means and a second member operatively connecting said first force field emanating means to said second motor element, said motor subunit interconnecting means comprises said first and second members, wherein said first and second force field emanating means are configured to operatively interfere with one another to limit expansion of said first and second motor subunits, whereby said first and second motor subunits are interlinked to form said motor unit.

7. The electrically controlled expansion and contraction device in accordance with claim 6, wherein said first force field emanating means comprises a first electromagnet, said second force field emanating means comprises a second electromagnet, and said first and second force fields each comprise a magnetic field.

8. The electrically controlled expansion and contraction device in accordance with claim 7, wherein said first and second motor elements each comprise a magnetic material.

9. The electrically powered expansion and contraction device in accordance with claim 8, wherein said magnetic material of said first and second motor elements is magnetized.

10. The electrically powered expansion and contraction device in accordance with claim 7, wherein said first motor element comprisers a first motor element electromagnet and said second motor element comprises a second motor element electromagnet.

11. The electrically controlled expansion and contraction device in accordance with claim 7, wherein said first member comprises said second electromagnet and said second member comprises said first electromagnet.

12. The electrically controlled expansion and contraction device in accordance with claim 11, wherein said first force field emanating means comprises a first substrate cooperatively supporting said first electromagnet and forming a first aperture, said second force field emanating means comprises a second substrate cooperatively supporting said second electromagnet and forming a second aperture, wherein said first electromagnet slidably engages said second aperture and said second electromagnet slidably engages said first aperture.

13. An electrically powered expansion and contraction device comprising a plurality of motor units having substantially collinear longitudinal axes, each of said plurality of motor units comprising:

(a) a first electromagnet for emanating a first magnetic field;

(b) a second electromagnet for emanating a second magnetic field;

(c) a first magnetic motor element movable with respect to said first magnetic field emanated therefrom, said first electromagnet and said first magnetic motor element comprising a first motor subunit, a first variable distance being between said first electromagnet and said first magnetic motor element, an increase of said first variable distance being an expansion of said first motor subunit and a decrease of said first variable distance being a contraction of said first motor subunit;

(d) a second magnetic motor element movable with respect to said second electromagnet and in response to said second magnetic field emanated therefrom, said second electromagnet and said second magnetic motor element comprising a second motor subunit, a second variable distance being between said second electromagnet and said second magnetic motor element, an increase of said second variable distance being an expansion of said second motor subunit and a decrease of said second variable distance being a contraction of said second motor subunit;

(e) a first member mechanically connecting said first magnetic motor element to said second electromagnet; a second member mechanically connecting said second motor element to said first electromagnet; and motor unit interconnecting means for mechanically connected said each motor unit to another one of said plurality of motor units, wherein said first and second motor units are interlinked, said first and second electromagnets being configured to operatively interfere with one another to limit expansion of said first and second motor subunits, whereby the cumulative expansions and contractions of said first and second motor subunits provide expansion and contraction of said each motor unit and the cumulative expansion and contractions of said motor units provide expansion and contraction of said expansion and contraction device.

14. An electrically powered expansion and contraction device comprising a plurality of motor units having substantially parallel longitudinal axes, each of said plurality of motor units comprising:

(a) a first electromagnet for emanating a first magnetic field;

(b) a second eletromagnet for emanating a second magnetic field;

(c) a first magnetic motor element movable with respect to said first electromagnet and in response to said first magnetic field emanated therefrom, said first electromagnet and said first magnetic motor element comprising a first motor subunit, a first variable distance being between said first electromagnet and said first magnetic motor element, an increase of said first variable distance being an expansion of said first motor subunit and a decrease of said first variable distance being a contraction of said first motor subunit;

(d) a second magnetic motor element movable with respect to said second electromagnet and in response to said second magnetic field emanated therefrom, said second electromagnet and said second magnetic subunit, a second variable distance being between said second electromagnet and said second magnetic motor element, an increase of said second variable distance being an expansion of said second motor subunit and a decrease of said second variable distance being a contraction of said second motor subunit;

(e) a first member mechanically connecting said first magnetic motor element to said second electromagnet; a second member mechanically connecting said second motor element to said first electromagnet; and motor unit interconnecting means for mechanically connecting said each motor unit to another one of said plurality of motor units, wherein said first and second motor units are interlinked, said first and second electromagnets being configured to operatively interfere with one another to limit expansion of said first and second motor subunits, whereby the cumulative expansions and contractions of said first and second motor subunits provide expansion and contraction of said each motor unit and the expansions and contractions of said parallel motor units provide expansion and contraction of said expansion and contraction device.

* * * * *

UNITED STATES PATENT AND TRADEMARK OFFICE

CERTIFICATE OF CORRECTION

PATENT NO. : 4,516,102

DATED : May 7, 1985

INVENTOR(S) : Mark C. Rask

It is certified that error appears in the above-identified patent and that said Letters Patent are hereby corrected as shown below:

Column 4, line 42, "Th" should be --The--.

Sheet 3 of the Drawings, Figure 8, reference numeral "20" should be --21--.

Signed and Sealed this

*Seventh* Day of *January 1986*

[SEAL]

*Attest:*

DONALD J. QUIGG

*Attesting Officer*

*Commissioner of Patents and Trademarks*